US007140133B2

(12) United States Patent
Hu et al.

(10) Patent No.: US 7,140,133 B2
(45) Date of Patent: Nov. 28, 2006

(54) LUGGAGE IDENTIFIER

(76) Inventors: Chih-Chang Hu, 3F, No. 9, Lane 17, Yung Kang St., Taipei (TW); Chung-Pei Hu, 11624, Jollyville Rd., Apt. 137, Austin, TX (US) 78759

( * ) Notice: Subject to any disclaimer, the term of this patent is extended or adjusted under 35 U.S.C. 154(b) by 0 days.

(21) Appl. No.: 11/106,512

(22) Filed: Apr. 15, 2005

(65) Prior Publication Data

US 2006/0230658 A1 Oct. 19, 2006

(51) Int. Cl.
*G09F 13/22* (2006.01)

(52) U.S. Cl. ..... 40/544; 40/6; 40/124.03

(58) Field of Classification Search ..... 40/6, 40/544, 299.01, 649, 661, 541, 124.03
See application file for complete search history.

(56) References Cited

U.S. PATENT DOCUMENTS 2,176,253 A * 10/1939 Fogarty ..... 40/661.06
5,412,887 A * 5/1995 Layne ..... 40/714
6,028,752 A * 2/2000 Chomette et al. ..... 360/137
2004/0237359 A1* 12/2004 Lee ..... 40/124.03
2004/0252030 A1* 12/2004 Trimble et al. ..... 340/825.36

FOREIGN PATENT DOCUMENTS

TW 509018 11/2002

* cited by examiner

*Primary Examiner*—J J Swann
*Assistant Examiner*—Mark T. Vogelbacker

(57) ABSTRACT

A luggage identifier, which is disposed on a luggage case or a luggage bag, includes a chassis and an identifying device, wherein the chassis includes a retaining space. The identifying device is disposed in the retaining space. The identifying device includes an identifying unit and a circuit board. The identifying unit is connected to the circuit board with a power switch connected therebetween. Accordingly, the user can easily and quickly identify his/her luggage case by recognizing the identifying device, thereby saving time on looking for the luggage case, and preventing himself/herself from claiming a luggage of other people.

15 Claims, 7 Drawing Sheets

LUGGAGE IDENTIFIER

BACKGROUND OF THE INVENTION

The present invention relates generally to a luggage identifier, and more particularly to a luggage identifier that is installed on a luggage case or bag, so as to identify the luggage of oneself, thereby reducing the time for searching for the luggage, and the possibility of claiming a wrong luggage.

Due to the advancement of transportation technology, more and more people travel around the world for leisure, for business, or for study. Among them, traveling around the world for leisure is one of the most exciting activities for modern people. However, one needs to prepare many things, such as documents and clothes, before departure. For this reason, a luggage case or bag is needed to place all those documents or clothes therein. In order to lower the cost for manufacturing luggage cases or bags, the manufacturer thereof needs to adopt a modulized design, thereby enhancing the efficiency of mass production. Therefore, there is no significant difference between the shape, style and color of luggage cases or bags. It is thus difficult for users to distinguish the luggage of themselves and those of others. Consequently, to provide a luggage identifier that can be used to easily identify a luggage is an important issue to address for people in the relevant industry.

One conventional luggage identifier is developed and disclosed in Taiwanese published patent no. 509018. In this conventional luggage identifier, a retaining space is formed on the handle of a luggage. A holding layer is then wrapped around the outer surface of the handle. Further, a control element is assembled on the handle. The handle is composed of transparent or semi-transparent materials. The retaining space formed on the handle includes a battery, a light emitting element and an electronic circuit therein. The light emitting element is connected to the battery via the electronic circuit. Therefore, the luggage handle can emit predetermined light source, so as to enhance the overall esthetics of the luggage.

However, conventional luggage identifiers comprise the following problems. Since the handle and the luggage main body are manufactured by the same factory, it is still very difficult to distinguish between luggage cases manufactured by the same company, which increases the possibility of claim a wrong luggage. In addition, the light emitting element of the conventional luggage identifier only emits light when holding the handle to switch on the electronic circuit. Therefore, the light emitting element is normally in a short circuit status, which is impossible to help identifying a luggage case.

In light of the above, the inventor of the present invention has developed a new luggage identifier so as to solve the problems set forth above.

BRIEF SUMMARY OF THE INVENTION

The present invention is to provide a luggage identifier, which includes a chassis and an identifying device. The user can easily and quickly identify his/her luggage case by recognizing the identifying device. Therefore, the user can save time on looking for the luggage case, and prevent himself/herself from claiming a luggage of other people.

In order to achieve the above and other objectives, the luggage identifier of the present invention, which is disposed on a luggage case or a luggage bag, includes a chassis and an identifying device, wherein the chassis includes a retaining space. The identifying device is disposed in the retaining space. The identifying device includes an identifying unit and a circuit board. The identifying unit is connected to the circuit board with a power switch connected therebetween. Accordingly, the objectives described above are achieved.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 1:
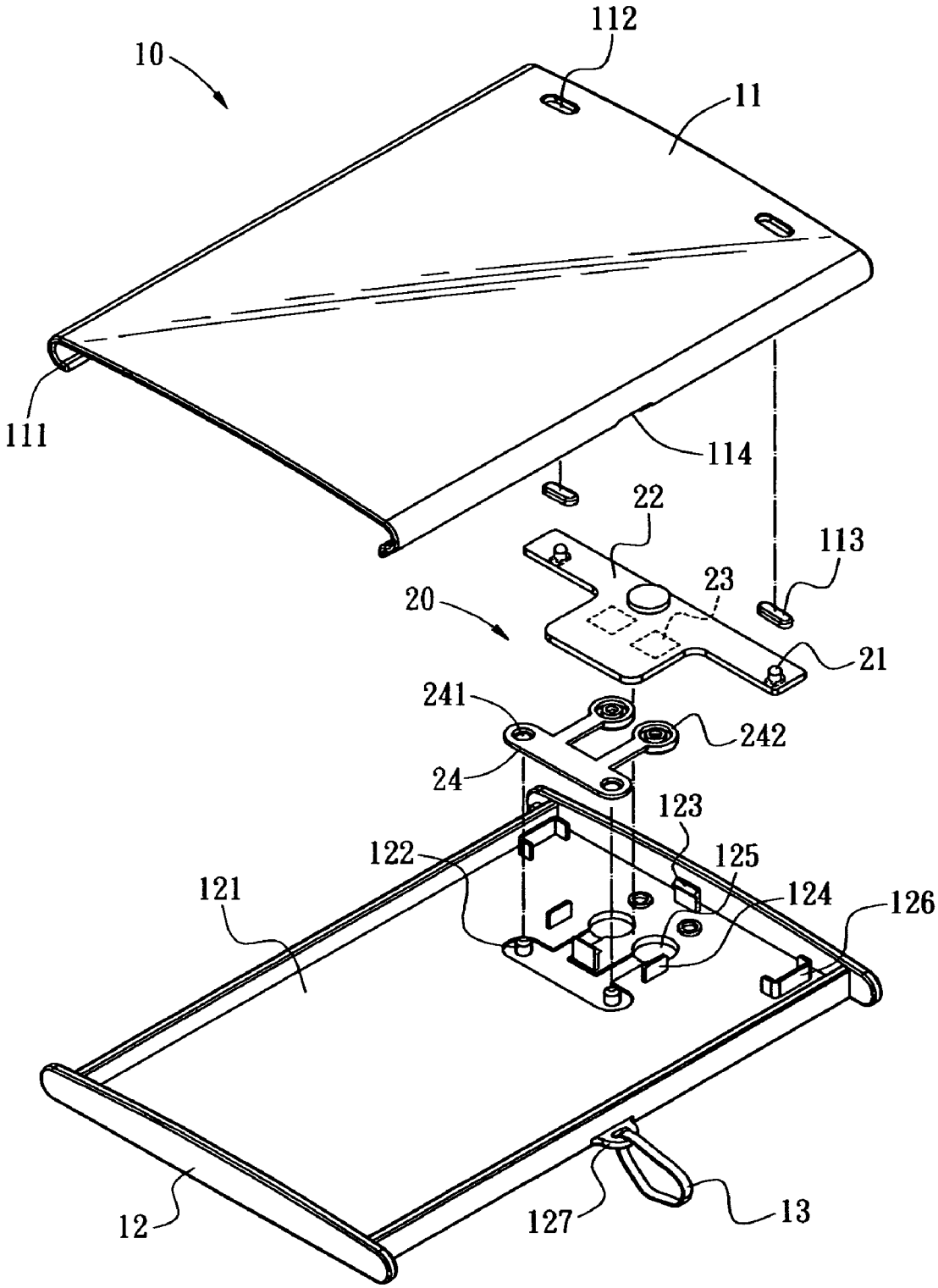
FIG. 1 is an explosive view illustrating the first embodiment of the present invention.
Figure 2:
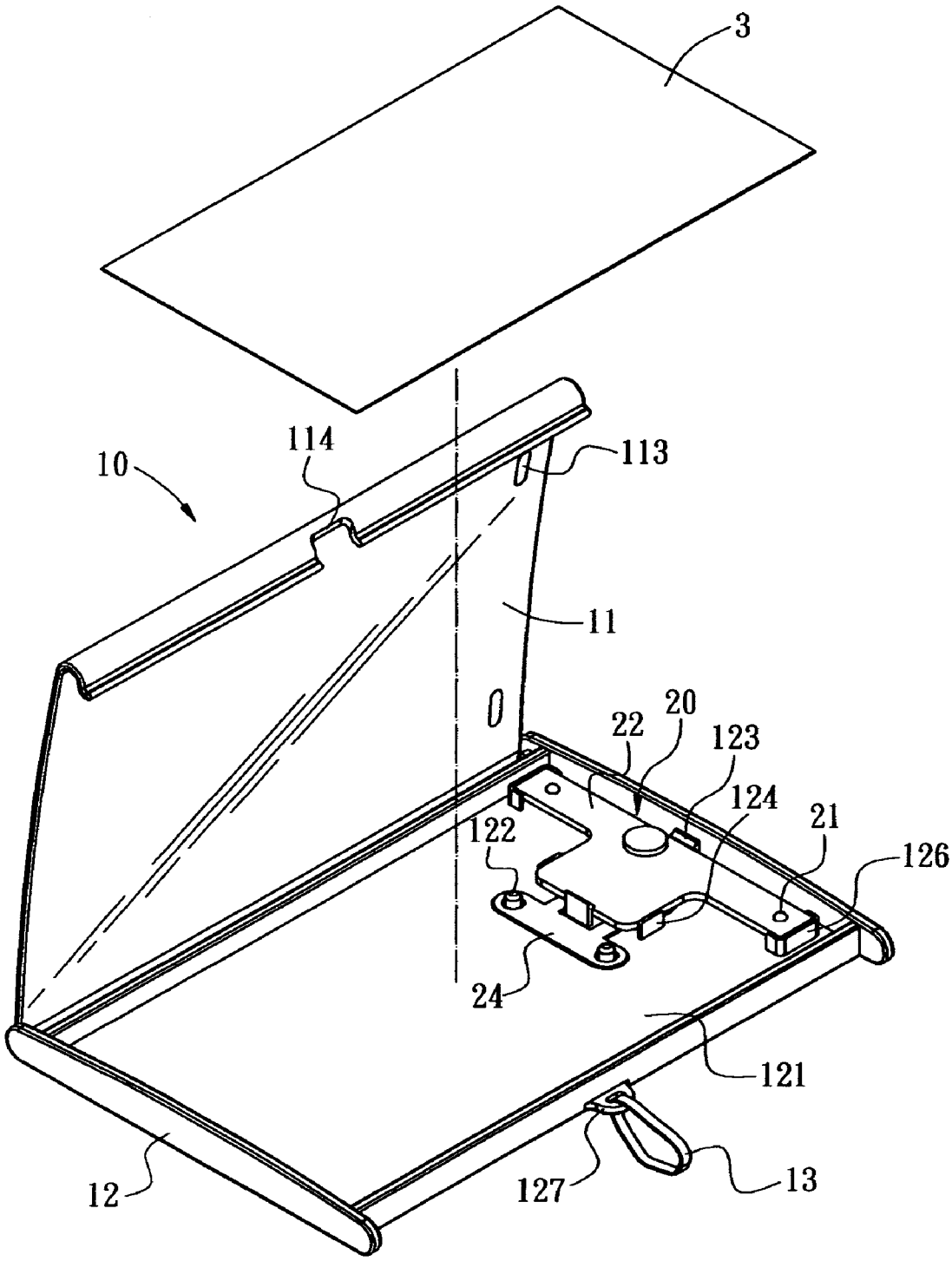
FIG. 2 is an explosive view illustrating the combination of a business card and the first embodiment of the present invention.
Figure 3:
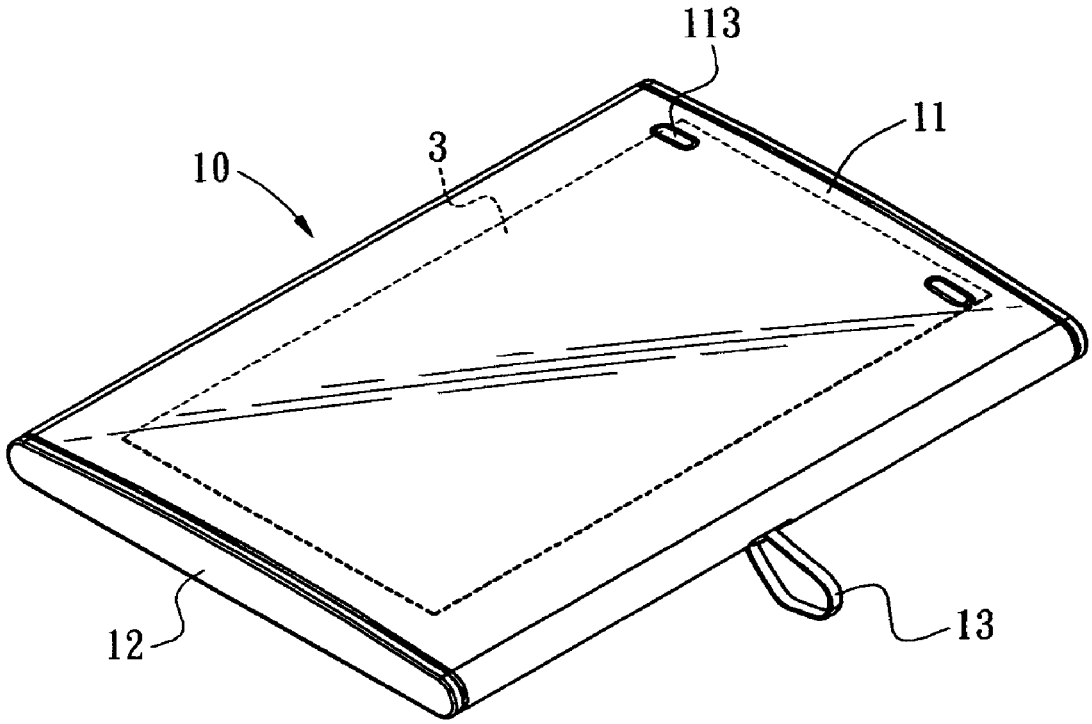
FIG. 3 is a perspective view illustrating the combination of a business card and the first embodiment of the present invention.

Referring to FIG. 1, FIG. 2 and FIG. 3, an explosive view of the first embodiment of the present invention, an explosive view and a perspective view of the combination of a business card and the first embodiment of the present invention, are illustrated, respectively. The luggage identifier of the present invention includes a chassis 10 and an identifying device 20.

The chassis 10 includes a first cover plate 11 and a second cover plate 12 connected to the first cover plate 11. The first cover plate 11 and the second cover plate 12 are connected via a pivotal element, a locking element, or a threaded element. In this particular embodiment, the first cover plate 11 and the second cover plate 12 are pivotally connected. The first cover plate 11 is composed of transparent, semi-transparent, or other materials. The left side of the first cover plate 11 includes a folded edge 111 formed thereon. In addition, the right and left end of the rear portion of the first cover plate 11 includes a through hole 112. A window 113 is disposed on the through hole 112. The window 113 is composed of transparent or semi-transparent materials. Moreover, the central portion of the right side of the first cover plate 11 includes a notch 114 formed thereon. The second cover plate 12 includes a retaining space 121. Two protrusive pillars 122 are disposed in the retaining space 121. Behind the two protrusive pillars 122, two hooks 123 and two sandwich plates 124 are formed extended therefrom. In addition, two holes 125 are formed between the hook 123 and the sandwich plate 124. A fastening plate 126 of U-shape is formed at the left and right sides of the rear portion of the retaining space 121, respectively. Furthermore, a protrusive ear 127 is formed at the center of the right side of the second cover plate 12. The protrusive ear 127 and the notch 114 of the first cover plate 11 are mutually connected and fastened. Moreover, an elastic locking belt 13 is disposed through the protrusive ear 127.

Figure 4:
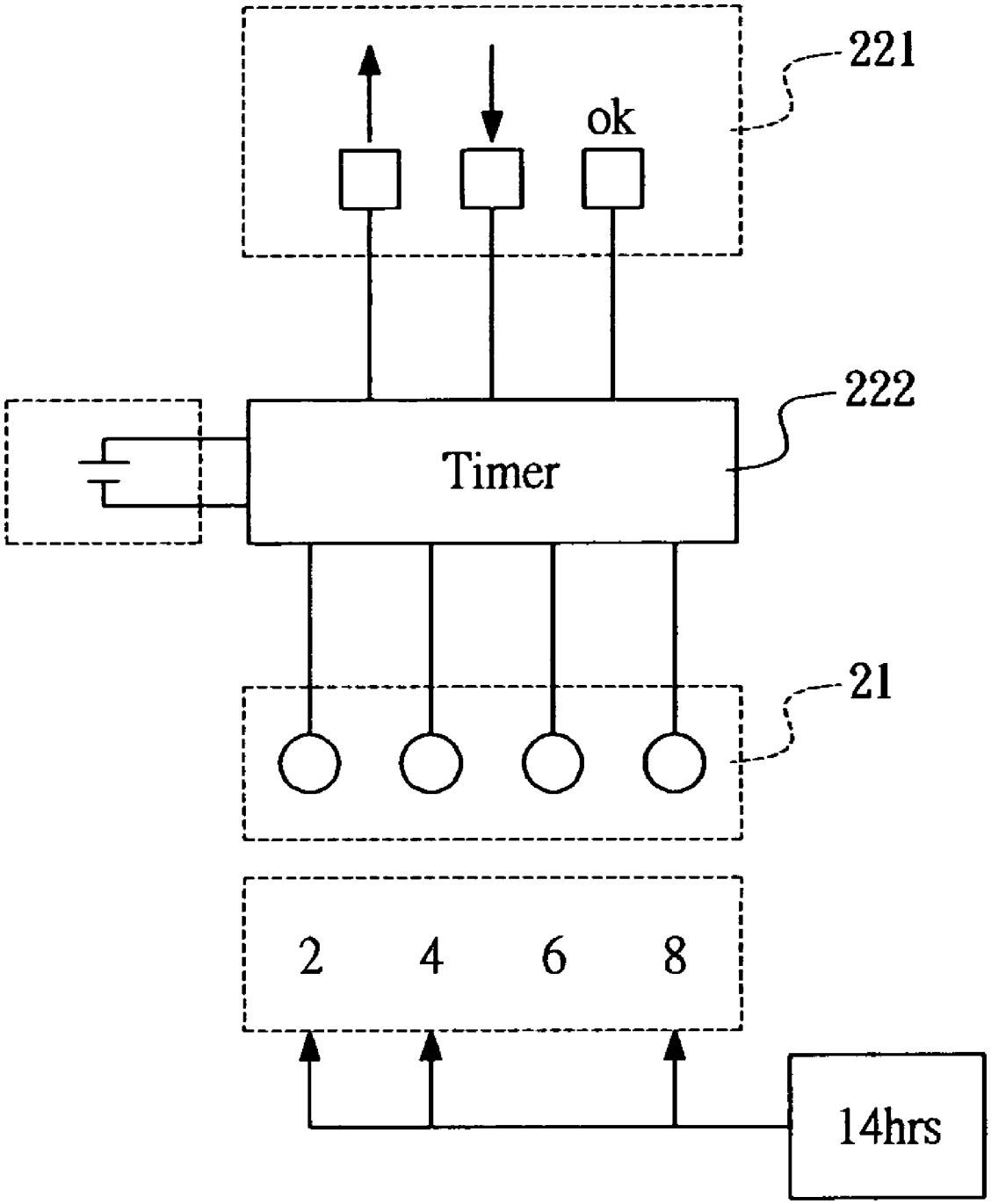
FIG. 4 is a circuit diagram of the present invention.

The identifying device 20 is disposed in the retaining space 121 of the chassis 10, which includes an identifying unit 21 and a circuit board 22. The identifying unit 21 is connected with the circuit board 22. A power switch 23 is electrically connected between the circuit board 22 and the identifying unit 21. The identifying unit 21 can be a light emitting element, a sound emitting element or an element emitting both light and sound. In this particular embodiment, the identifying element 21 is a light emitting element made of a granular light emitting diode (LED). Referring also to FIG. 4, a circuit diagram of the present invention is illustrated. The circuit board 22 is in T-shape, which includes a configuration unit 221 and a control unit 222. The control unit 222 can be a timer, while the configuration unit 221 can only be the power switch 23 or elements of other functions operable via a button set 24. The button set 24 is disposed between the circuit board 22 and the second cover 12, which includes two through holes 241. The through holes 241 provides the protrusive pillars 122 of the second cover plate 12 to penetrate therethrough. Two pressing cups 242 are formed behind the through holes 241 corresponding to the two holes 125 of the second cover plate 12. In addition, the identifying unit 21 is executed after receiving a signal from the control unit 222, thereby generating a corresponding flashing light or sound.

In combination, the through hole 241 of the button set 24 is inserted the protrusive pillar 122 of the second cover plate 12, and the pressing cap 242 is contained in the hole 125 of the second cover plate 12. Then, the circuit board 22 is stacked above the button set 24, making the front portion of the circuit board 22 being sandwiched between the two sandwich plates 124. Two ends of the rear portion of the circuit board 22 are contained in the fastening board 126, and pressing the hooks 123 just above the circuit board 22. Moreover, a business card 3 is disposed in the retaining space 121 of the second cover plate 12, thereby allowing the user to correctly recognize the luggage case. The first cover plate 11 is then covered on the second cover plate, wherein the notch 114 and the protrusive ear 127 are securely fastened with each other.

Figure 5:
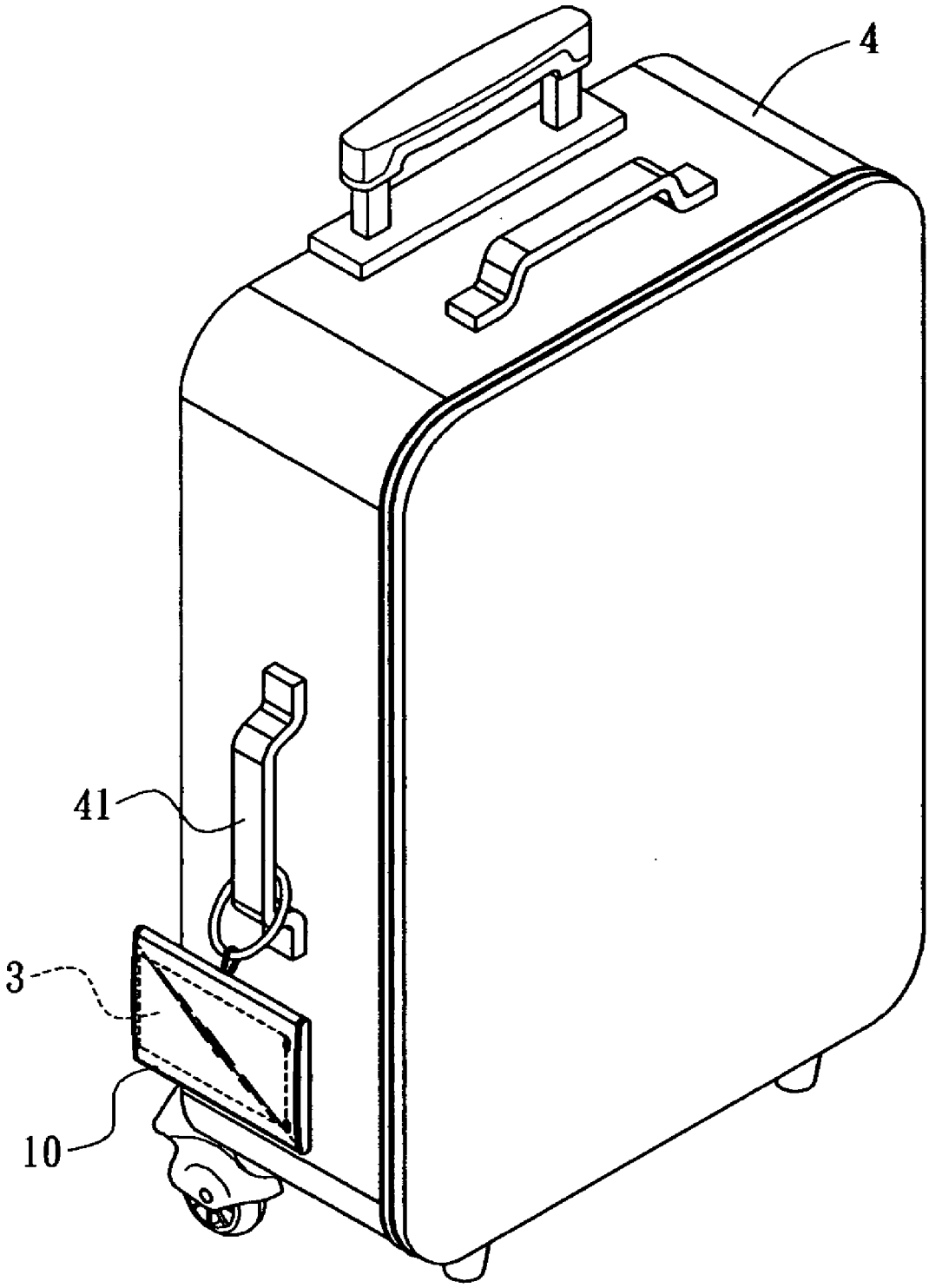
FIG. 5 is a schematic diagram of the present invention applied to a luggage case.

Referring to FIG. 5, a schematic diagram of the present invention applied to a luggage case is illustrated. The luggage identifier of the present invention can be connected to a luggage case 4 via a locking belt. In this particular embodiment, the luggage identifier of the present invention is connected to the handle 41 of the luggage case 4. When using the luggage identifier, a business card 3 is first disposed in the retaining space 121. The pressing cap 242 of the button set 24 is pressed to set the time. Referring to FIG. 4, the up and down arrows of the configuration unit 221 are used to set the time. In this particular embodiment, the minimum time is two hours and the maximum time is 20 hours, depending on the distance between the departure and destination locations, so as to enhance the battery lifetime. The OK button is pressed after the time is set. When the configured set time is reached, the identifying unit 21 will generate flashing light or sound. Moreover, the set time is calculated by addition, e.g. 2+4+8=14 hours.

Figure 6:
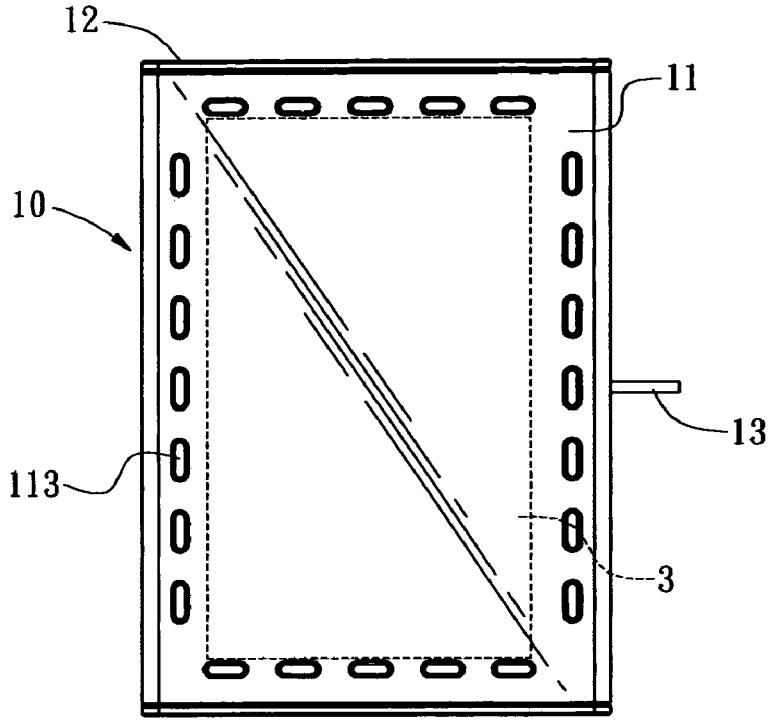
FIG. 6 is a perspective view illustrating the second embodiment of the present invention.
Figure 7:
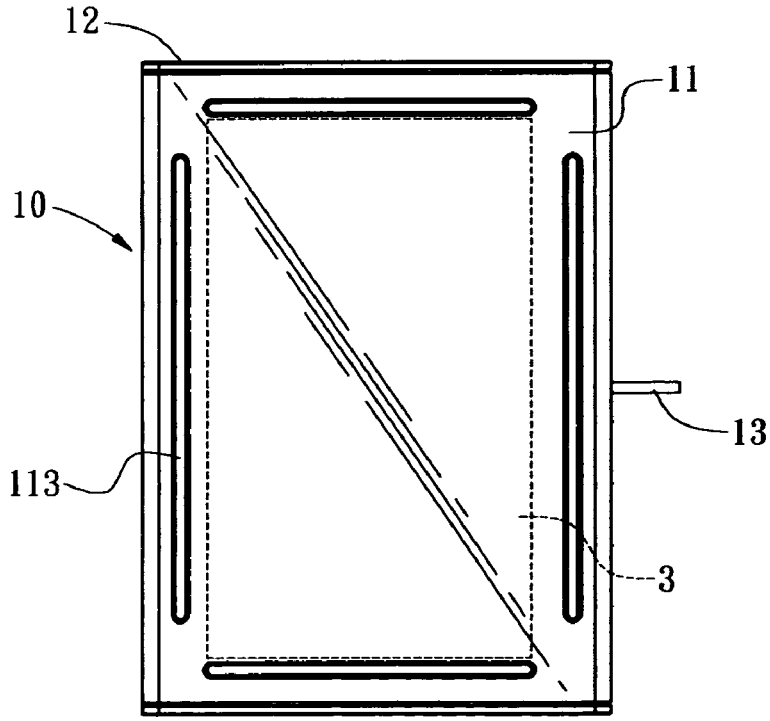
FIG. 7 is a perspective view illustrating the third embodiment of the present invention.

Referring to FIG. 6 and FIG. 7, a perspective view of the second and the third embodiments of the present invention are illustrated. In addition to the embodiment described above, the luggage identifier of the present invention can also include a plurality of through holes 112, windows 113 and identifying units 21 corresponding to the through holes 112 and the windows 113 around the first cover plate 11. By incorporating with the circuit design of the circuit board 22, the effect of flashing light circumventing the luggage identifier can be obtained. Similarly, the through holes 112 of the second embodiment of the present invention can be altered to form a long groove, as shown in FIG. 7. By incorporating with a long window 113 or by inserting a long light emitting body into the through hole 112, similar effect is obtained as that of the embodiments described above.

Figure 8:
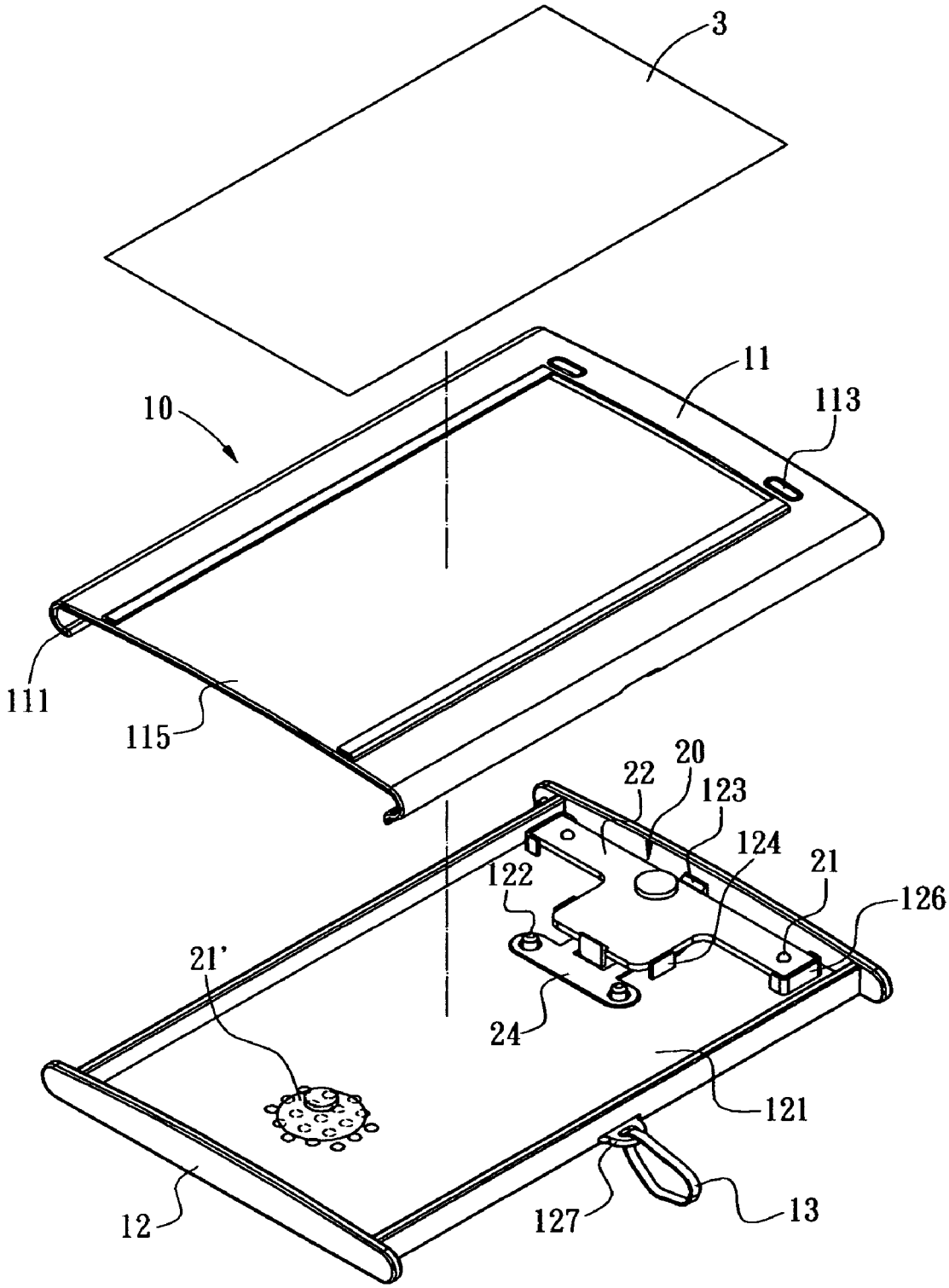
FIG. 8 is an explosive view illustrating the fourth embodiment of the present invention.

Referring to FIG. 8, an explosive view illustrating the fourth embodiment of the present invention is illustrated. In addition to the embodiments described above, the first cover plate 11 of the present invention can also include an insertion groove 115 extensively formed on the top surface of the first cover plate 11, so as to provide a business card 3 to insert therein. Moreover, the retaining space 121 of the second cover plate 12 can include an additional identifying unit 21'. The identifying unit 21' can be a sound generating device, such as a buzzer.

In summary, the luggage identifier of the present invention indeed satisfies the utility, novelty, and non-obviousness requirements in the patent law, a grant of letters patent therefor is thus respectfully requested.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A luggage identifier, comprising:

a chassis having a retaining space, having a first cover plate and a second cover plate connected to the first cover plate, the first cover plate and the second cover plate having the retaining space formed thereon;

the second cover plate further comprising a protrusive pillar formed thereon, and a button set having a through hole disposed between a circuit board and the second cover plate, and a hook and a sandwich plate are formed on one side of the protrusive pillar, whereby the circuit board and the button set are fastened with each other, a hole formed in the second cover plate is located between the hook and the sandwich plate, and the button set having a pressing cap, which is contained in the hole; and an identifying device disposed in the retaining space of the chassis, wherein the identifying device comprises an identifying unit and the circuit board having a control unit, the control unit comprising a timer, which a user can use the timer to active the identifying unit at a user preset time, the identifying unit being connected to the circuit board with a power switch connected therebetween.

2. The luggage identifier as recited in claim 1, wherein the first cover plate comprises a through hole formed thereon, and a window formed on the through hole, the through hole being formed corresponding to the window.

3. The luggage identifier as recited in claim 2, wherein the window is made of a transparent or a semi-transparent material.

4. The luggage identifier as recited in claim 1, wherein the first cover plate comprises a notch formed thereon, and the second cover plate comprises a protrusive ear formed thereon, whereby the protrusive ear and the notch are securely fastened with each other.

5. The luggage identifier as recited in claim 1, wherein the first cover plate comprises an insertion groove formed thereon.

6. The luggage identifier as recited in claim 1, wherein the identifying unit comprises one of a light emitting body, a sound producing device, or a combination thereof.

7. The luggage identifier as recited in claim 6, wherein the light emitting body is of a long shape or a granular shape.

8. A luggage identifier, comprising:

a chassis having a first cover plate and a second cover plate connected to the first cover plate, the first cover plate and the second cover plate having a retaining space formed thereon; and an identifying device disposed in the retaining space of the chassis, wherein the identifying device comprises an identifying unit, a circuit board and a button set having a through hole disposed between a circuit board and the second cover plate, the through hole and a protrusive pillar are formed on the second cover plate, where the identifying unit being connected to the circuit board with a power switch connected therebetween, and, a hook and a sandwich plate are formed on one side of the protrusive pillar, wherein a hole is formed in the second cover plate and located between the hook and the sandwich plate, whereby the circuit board and the button set are fastened with each other, and the button set which comprises a pressing cap, the pressing cap being contained in the hole.

9. The luggage identifier as recited in claim 8, wherein the first cover plate comprises a through hole formed thereon, and a window formed on the through hole, the through hole being formed corresponding to the window.

10. The luggage identifier as recited in claim 9, wherein the window is made of a transparent or a semi-transparent material.

11. The luggage identifier as recited in claim 8, wherein the first cover plate comprises a notch formed thereon, and the second cover plate comprises a protrusive ear formed thereon, whereby the protrusive ear and the notch are securely fastened with each other.

12. The luggage identifier as recited in claim 8, wherein the first cover plate comprises an insertion groove formed thereon.

13. The luggage identifier as recited in claim 8, wherein the identifying unit comprises one of a light emitting body, a sound producing device, or a combination thereof.

14. The luggage identifier as recited in claim 13, wherein the light emitting body is of a long shape or a granular shape.

15. The luggage identifier as recited in claim 8, wherein the circuit board further comprises a control unit, the control unit comprising a timer.

* * * * *